United States Patent [19]

Bates, Jr.

[11] 4,032,052

[45] June 28, 1977

[54] FRINGE AND TASSEL MAKER

[75] Inventor: Hamilton Canfield Bates, Jr., Chester, Conn.

[73] Assignee: C. J. Bates & Son, Inc., Chester, Conn.

[22] Filed: Aug. 9, 1976

[21] Appl. No.: 712,486

[52] U.S. Cl. ..... 223/46; 28/147

[51] Int. Cl.[2] ..... A41H 43/00

[58] Field of Search ..... 28/2, 15, 72 R; 223/44, 223/46

[56] References Cited

UNITED STATES PATENTS

| | | | |
|---|---|---|---|
| 975,355 | 11/1910 | Gurtler | 28/2 X |
| 2,828,896 | 4/1958 | Hanselman | 223/46 |
| 3,429,019 | 2/1969 | Linstad | 28/2 X |
| 3,827,091 | 8/1974 | Hocevar | 28/15 X |

*Primary Examiner*—G. V. Larkin

*Attorney, Agent, or Firm*—Ross, Ross & Flavin

[57] ABSTRACT

A fringe and tassel maker comprising a base member having an integral winding and cutting abutment at one end thereof, and having a slide member releasably fixed thereto in spaced relation to the winding and cutting abutment, the slide member having a pair of winding surfaces and a pair of cutting areas thereon, and the winding and cutting abutment having a winding surface and a cutting area thereon, the slide member being selectively positionable relative to and along the length of the base member for providing different lengths of fringes and tassels obtained by winding yarn around the several winding surfaces and cutting the yarn at one or more of the cutting areas.

4 Claims, 10 Drawing Figures

FRINGE AND TASSEL MAKER

A primary object of the invention is to provide an efficient, versatile and inexpensive device for quickly and easily measuring and permitting the cutting of exact yarn lengths for fringe, tassels, woven afghans and hooked rugs.

Another object is to provide such a device which may be easily adjusted to produce virtually any desired yarn length.

In the drawings

Figure 1:
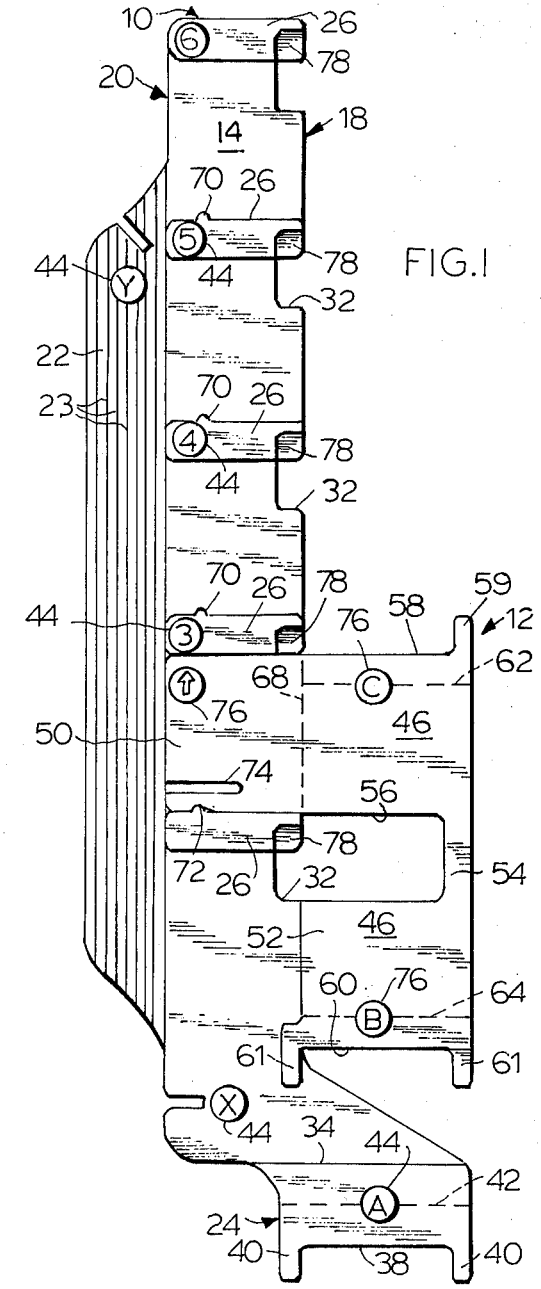
FIG. 1 is a front elevational view of a fringe and tassel maker embodying the invention.
Figure 2:
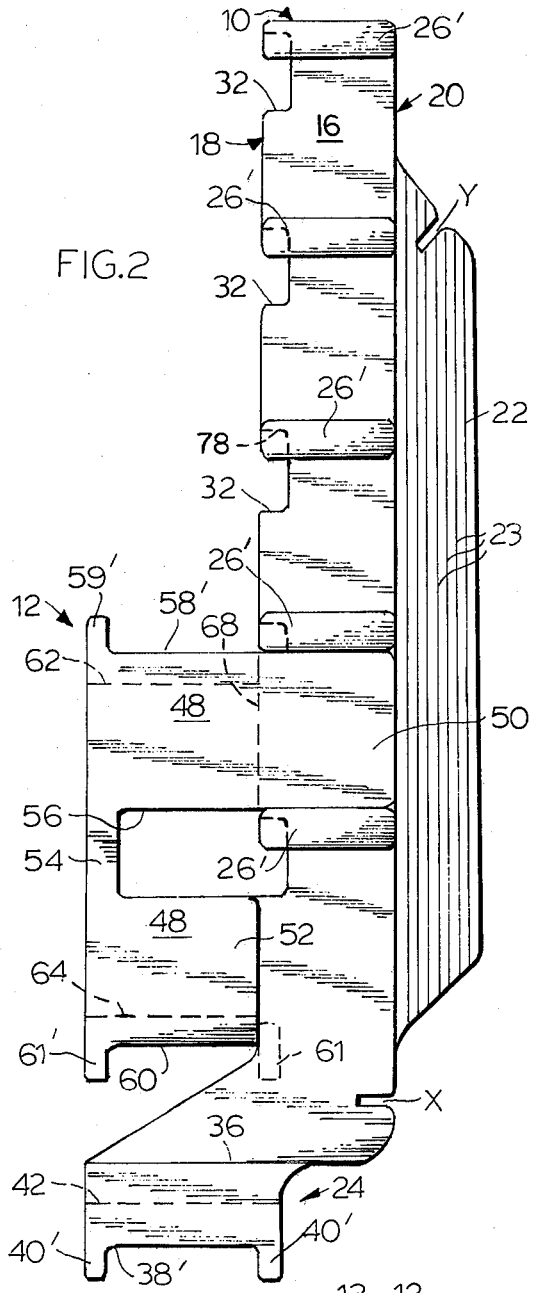
FIG. 2 is a rear elevational view thereof.
Figure 3:
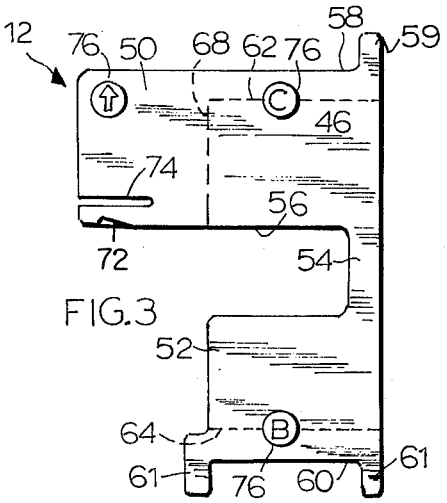
FIG. 3 is a front elevational view of the slide member of the fringe and tassel maker.
Figure 4:
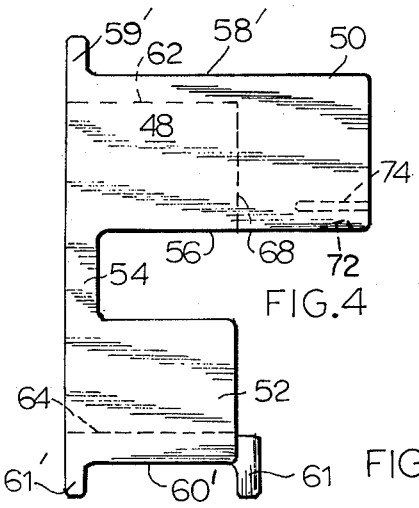
FIG. 4 is a rear elevational view of the slide member of FIG. 3.

The device of the invention includes a base member 10 and a slide member 12 extending outwardly normal to and releasably fixed to the base member.

The base member, which is somewhat L-shaped in plan, has opposite planar faces 14 and 16 and spaced parallel longitudinal edges 18 and 20, with an integral hand grip portion 22 provided along edge 20, and with an integral winding and cutting abutment 24 extending outwardly from longitudinal edge 18 at the lower end thereof normal thereto.

Hand grip portion 22 may be provided with ribs 23 or the like for better gripability.

A plurality of equi-spaced, parallel ribs 26 are provided on planar face 14 of the base member and extend horizontally inwardly from edge 18 thereof.

A like number of ribs 26′ provided on the opposite planar face 16 of the base member extend horizontally inwardly from edge 18 and are aligned with ribs 26.

Slots X and Y are provided adjacent the lower and upper ends respectively of the base member for holding the end of yarn T (see FIG. 9), while the yarn is being wound.

Edge 18 of the base member is cut away between certain of the ribs 26 to provide recesses 32 for purposes to appear.

Winding and cutting abutment 24 includes a pair of spaced, parallel walls 34 and 36 which extend downwardly from the lower end of base member 10. Wall 34 is cut away at its lower edge to provide a recess 38 which defines a winding surface having depending fingers 40 at its opposite ends. Wall 36 is also cut away at its lower edge to provide a recess 38′ which defines a winding surface having depending fingers 40′ at its opposite ends, with recesses 38 and 38′ being complemental to each other and fingers 40 and 40′ being complemental to each other.

Figure 7:
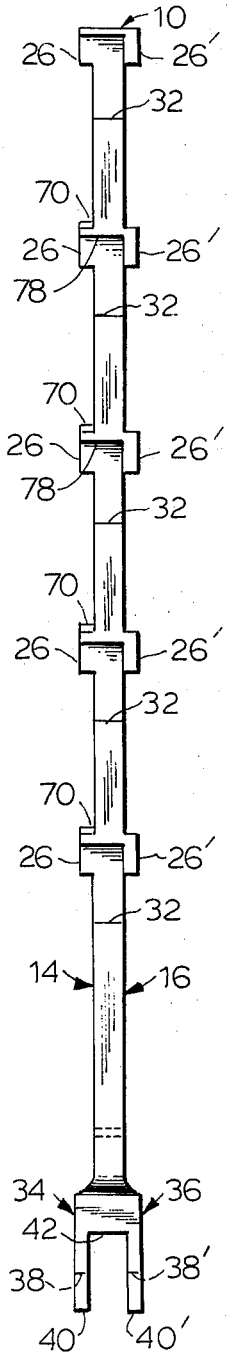
FIG. 7 is a side elevational view of the fringe and tassel maker as seen from the right of FIG. 1, with the slide member removed.
Figure 8:
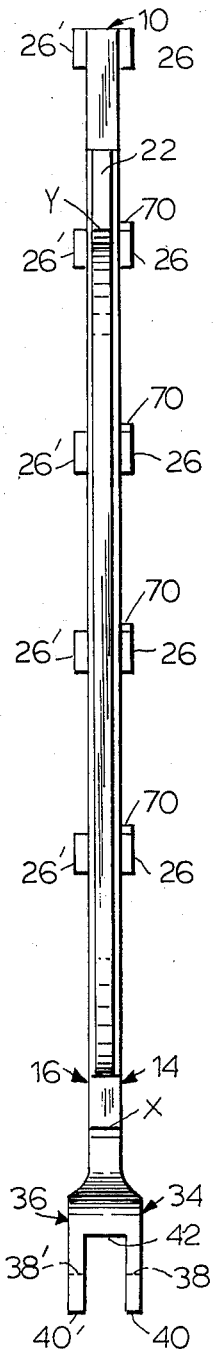
FIG. 8 is a side elevational view of the fringe and tassel maker as seen from the left of FIG. 1, with the slide member removed.

As best seen in FIGS. 7 and 8, a groove 42 is located centrally between walls 34 and 36 and extends inwardly from the lower edges of those walls, the groove defining a cutting area which extends the length of the winding and cutting abutment and permits the insertion of scissors between the walls for cutting yarn.

Indicia 44, (which includes the indicia X and Y), are provided on face 14 of the base member to assist the user in setting the device for different yarn lengths, as will appear.

Slide member 12 is slidably and releasably fixed to base member 10 for quick and easy repositioning along the length of the base member to set the device for different yarn lengths.

The slide member has opposite planar faces 46 and 48 and includes a pair of spaced, parallel, horizontally-extending upper and lower arms 50 and 52 respectively which extend outwardly from and normal to a vertically-extending web portion 54 connecting therebetween, the arms being separated by a horizontally-extending, generally rectangular recess 56, for purposes to appear.

Planar face 46 is cut away along the upper edge of upper arm 50 to provide a recess 58 which defines a winding surface having an upstanding finger 59 at its outer end which extends upwardly from web portion 54.

Planar face 48 is similarly cut away along the upper edge of upper arm 50 to provide a recess 58′ which defines a winding surface having an upstanding finger 59′ at its outer end which extends upwardly from web portion 54.

Recesses 58 and 58′ are complemental to each other and fingers 59 and 59′ are complemental to each other.

The recesses 58 and 58′ together define winding surfaces for accepting yarn to be wound around the upper arm 50 and lower arm 52 or around the upper arm and winding and cutting abutment 24.

Planar face 46 is cut away along the lower edge of lower arm 52 to provide a recess 60 which defines a winding surface having depending fingers 61 at its opposite ends.

Planar face 48 is similarly cut away along the lower edge of lower arm 52 to provide a recess 60′ which defines a winding surface having a depending finger 61′ at its outer end and extending downwardly from web portion 54.

The recesses 60 and 60′ are complemental to each other and the fingers 61 and 61′ are complemental to each other, it being observed, however, that only one finger 61′ depends from planar face 48, while a pair of fingers 61 depend from planar face 46, for purposes to appear.

The recesses 60 and 60′ together define winding surfaces for accepting yarn to be wound around upper and lower arms 50 and 52.

Figure 5:
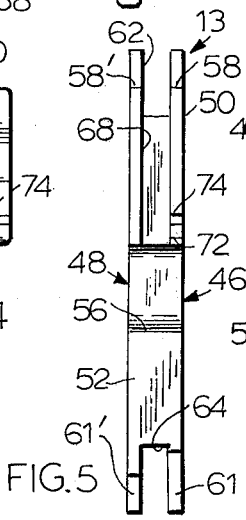
FIG. 5 is a side elevational view of the slide member as seen from the left of FIG. 3.
Figure 6:
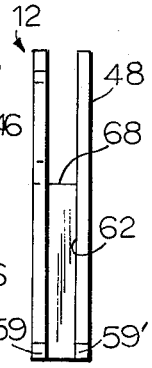
FIG. 6 is a top plan view of the slide member.

A horizontally-disposed groove 62, best seen in FIG. 5, is located centrally between planar faces 46 and 48 and extends inwardly from the upper edge of upper arm 50, the groove defining a cutting area which extends the length of the upper arm and permits the insertion of scissors for cutting yarn.

A similar horizontally-disposed groove 64 is provided on lower arm 52 and is located centrally between planar faces 46 and 48, groove 64 extending inwardly from the lower edge of lower arm 52 and defining a cutting area which extends the length of the lower arm and permits the insertion of scissors for cutting yarn.

The upper arm is additionally provided with a centrally-located, inwardly-extending, vertically-disposed slot 68, best seen in FIG. 5, between planar faces 46 and 48, of suitable width so that the upper arm can be slid upon the base member 10 between pairs of ribs 26 and pairs of ribs 26', with one wall of slot 68 bearing against planar face 14 of the base member and with the other wall of the slot bearing against planar face 16 of the base member.

In effect, the spaced pairs of ribs 26 and the spaced pairs of ribs 26' form guideways for upper arm 50 of the slide member.

Each rib 26 is provided, adjacent its inner end, with an arcuate projection 70 which extends upwardly from the upper edge of the rib.

A notch 72 on planar face 46 in the lower surface of upper arm 50 of slide member 12 is adapted to receive one of the projections 70 therein when the slide member is slid onto the base member, the projection serving to insure against accidental separation of the two components.

A horizontally-disposed slot 74 is provided in the forward end of upper arm 50 on planar face 46, the slot providing spring or resilience permitting the notch 72 to snap into place on the projection 70.

Indicia 76 are provided on face 46 of slide member 12 to assist the user in setting the device for making different lengths of fringes and tassels.

The outer ends of certain of the ribs 26 and the edge 18 of the base member 10 are cut away as at 78 to provide cutting room for scissors inserted in the grooves 62 and 64 of slide member 12.

The recesses 32 in the edge 18 of the base member align with the recess 56 in the slide member to provide an enlarged slot for tassel tying.

The chart below shows the various lengths of fringe which can be made with the device, the figure and letter references used indicating the indicia 44 on the base member and the indicia 76 on the slide member.

Of course, it will be understood that the size of the device can be varied to provide other lengths, the chart being illustrative of one size only.

| SET SLIDE AT: | START AT: | WIND: | CUT AT: | APPROX. FRINGE LENGTH |
|---|---|---|---|---|
| 3 | A | A-C-A-repeat | A | 3" |
| 4 | A | A-C-A-repeat | A | 4" |
| 5 | A | A-C-A-repeat | A | 5" |
| 6 | A | A-C-A-repeat | A | 6" |
| 5 | A | A-C-B-C-A-repeat | A | 7" |
| 6 | A | A-C-B-C-A-repeat | A | 8" |
| 4 | B | B-C-A-C-A-C-B-repeat | B | 10" |
| 5 | B | B-C-A-C-A-C-B-repeat | B | 12" |
| 6 | B | B-C-A-C-A-C-B-repeat | B | 14" |
| 5 | B | B-C-A-C-A-C-A-C-B-repeat | B | 17–18" |
| 6 | B | B-C-A-C-A-C-A-C-B-repeat | B | 20" |
| | | FOR RUG YARN | | |
| 4 | B | B-C-B-repeat | B&C | 2½" |

The structure of the device having been described, it should be pointed out that the scissors groove 64 in lower arm 52 of the slide member makes it possible to make virtually unlimited lengths of fringe. The groove 64 permits fringe to be made well beyond a 7 inch length, feasibly up to 20 inches or more. Along with winding from A to C, the possibility of additional short winds around B and c allows for unlimited increments of lengths of fringe also.

For instance, if an 8 inch fringe is desired, set the slide at 6, wind A to C, then B to C and back to A, cutting at A. This produces an 8 inch fringe, (the 6 inch long wind plus the 2 inch B to C short wind). An 8 inch fringe is made with a 16 inch length of yarn doubled.

To demonstrate how scissors groove 64 is used, assume that it is desired to make a 14 inch fringe. This is not feasable by winding twice around A to C as every other strand would have to be cut. This is impossible when there are ten or twenty windings. Consequently, to make a 14 inch fringe, with slide member 12 set at 6, the user starts at B, goes around C, then A to C to A to C to B. The yarn is cut at B. By providing the scissors groove 64, any number of long turns (A to C) can be combined with one short turn to give infinite lengths.

Figure 9:
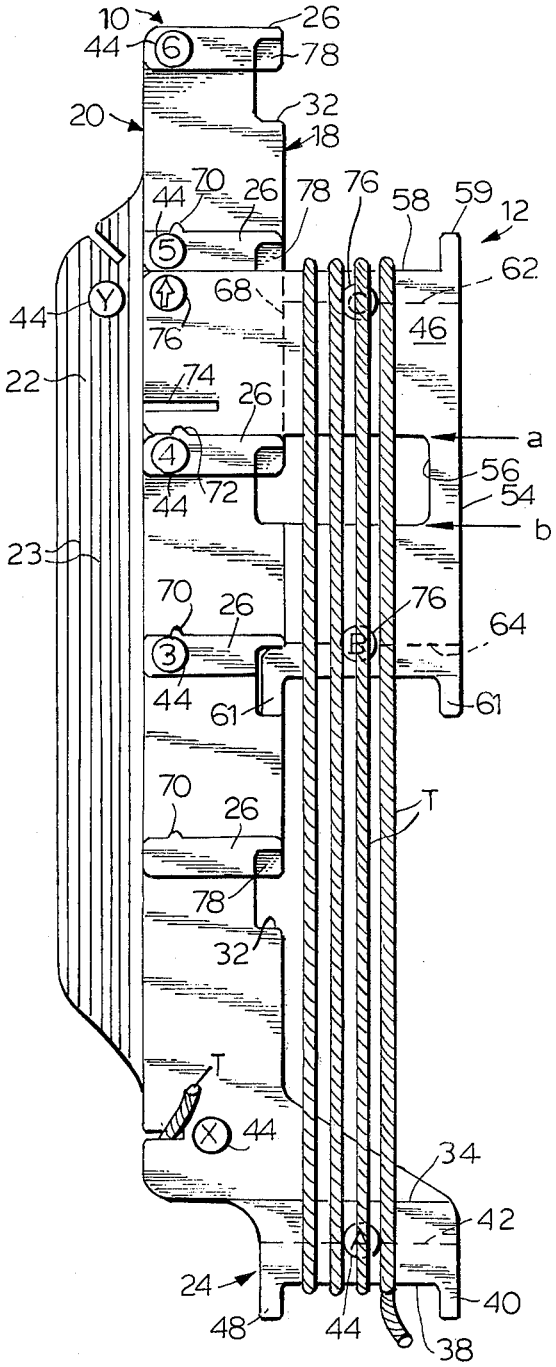
FIG. 9 is a front elevational view showing the manner of use of the fringe and tassel maker.

Although the primary purpose of the device is for making fringe, 3 to 6 inch tassels can be made very easily and quickly by winding A to c about 20 times, locking the end of the yarn in slot X and tying at the short or medium tying lines as indicated by the arrows *a* and *b* respectively in FIG. 9 as defined by the upper and lower walls respectively of recess 56. The yarn is then cut at the scissors groove 42 at A on winding abutment 24 and the slide member 12 disengaged from base member 10.

Figure 10:
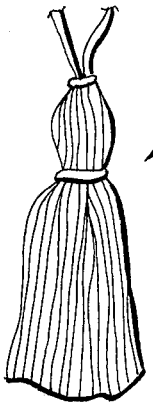
FIG. 10 is a perspective view of a tassel formed by using the fringe and tassel maker of the invention.

The top of the tassel head is tied through groove 62 at C on the slide member and the finished tassel W of the type shown in FIG. 10 is removed from the slide member. For convenience, a yarn needle is used for both tying operations.

Another function well suited to the device is the cutting of rug yarn to be used for hooked rugs. By setting the slide member 12 at any position along base 10, winding B to C, then holding onto the yarn in the area below C and cutting at B and C, the most frequently used yarn length is obtained for rug making.

It should be pointed out that the dimension from B to C is such as to provide the rug yarn length most frequently used.

The inner finger 61 depending from planar face 46 of slide member 12 is helpful when winding yarn from C to B in that it precludes the loops of yarn around B from sliding into the recesses 32 in base member 10. This is particularly true when many turns are wound B to C as occurs when cutting yarn for rug making.

The arrow of the indicia 76 on slide member 12 is useful in setting the position of the slide member, the arrow being so positioned on the slide member as to be aligned with one of the numerals 3, 4, 5 or 6 of the indicia 44 of base member 10, the latter corresponding to the length of fringe which can be made at each of those settings.

For example, in FIG. 9, slide member 12 is set in position 5, with the arrow on the slide member pointing to the 5 on the base member for cutting a 5 inch fringe.

The slide member can be positioned at a suitable setting along base member 10 and the yarn wound from A to C to produce any desired yarn length.

While in FIG. 9, the yarn is shown as being wound from A to C, it will be understood that it can also be wound from B to C. In other words, a turn A to C, the next turn B to C and so on.

I claim:

1. A fringe and tassal maker comprising, a base member having a winding and cutting abutment at one end thereof and having a slide member releasably fixed thereto, the slide member having a pair of winding surfaces and a pair of cutting areas thereon, the winding and cutting abutment having a winding surface and a cutting area thereon, and the slide member being selectively positionable along and relative to the base member for providing different lengths of fringes and tassels obtained by winding yarn around selected ones of the winding surfaces and cutting the yarn at selected ones of the cutting areas.

2. A fringe and tassel maker according to claim 1, the base member having a plurality of sapced ribs thereon, the ribs forming guideways for the slide member which, on attachment to the base member extends normal to the base member in vertical alignment with the winding and cutting abutment.

3. A fringe and tassel maker according to claim 1, the slide member having a pair of upper and lower arms separated by a recess and interconnected by a web member, the upper arm having a winding surface and a cutting area thereon and the lower arm having a winding surface and a cutting area thereon.

4. A fringe and tassel maker according to claim 3, the recess defining short and medium tying lines for tassels.

* * * * *